US005322279A

United States Patent [19]

Davis et al.

[11] Patent Number: 5,322,279

[45] Date of Patent: Jun. 21, 1994

[54] DOUBLE STRUNG TENNIS RACQUET

[75] Inventors: Stephen J. Davis, Washington Crossing; André Terzaghi, Havertown; Richard Hulock, Quakertown; William Harvie, Yardley, all of Pa.

[73] Assignee: Prince Manufacturing, Inc., Lawrenceville, N.J.

[21] Appl. No.: 108,161

[22] Filed: Aug. 16, 1993

Related U.S. Application Data

[63] Continuation of Ser. No. 989,267, Dec. 11, 1992, abandoned.

[51] Int. Cl.[5] ..... A63B 51/06

[52] U.S. Cl. ..... 273/73 D

[58] Field of Search ..... 273/73 R, 73 C, 73 D, 273/73 G, 73 L

[56] References Cited

U.S. PATENT DOCUMENTS 3,968,966 7/1976 D'Aquanni ..... 273/73 D
4,049,269 9/1977 Blackburne .
4,204,680 5/1980 Blackburne .
4,320,900 3/1982 Blackburne .
4,804,183 2/1989 Duran et al. ..... 273/73 C
5,009,422 4/1991 Soong ..... 273/73 D

FOREIGN PATENT DOCUMENTS 3924674 12/1989 Fed. Rep. of Germany ... 273/73 D

*Primary Examiner*—Vincent Millin
*Assistant Examiner*—Raleigh W. Chiu
*Attorney, Agent, or Firm*—White & Case

[57] ABSTRACT

A tennis racquet has a frame which includes a frame head portion with an outwardly facing stringing groove and an inwardly facing surface which is generally convex. The stringing groove includes a pair of angled side wall surfaces. A series of stringing holes extend through each side wall surface and the opposing convex surface to define holes for a pair of generally parallel stringing surfaces. Preferably, the string holes extend at an angle of about 45° relative to the central plane of the stringing area, and the angled surfaces in the stringing groove, and the opposing surface on the convex surface, are parallel to one another and generally perpendicular to the direction of the string hole.

3 Claims, 9 Drawing Sheets

FIG. 10
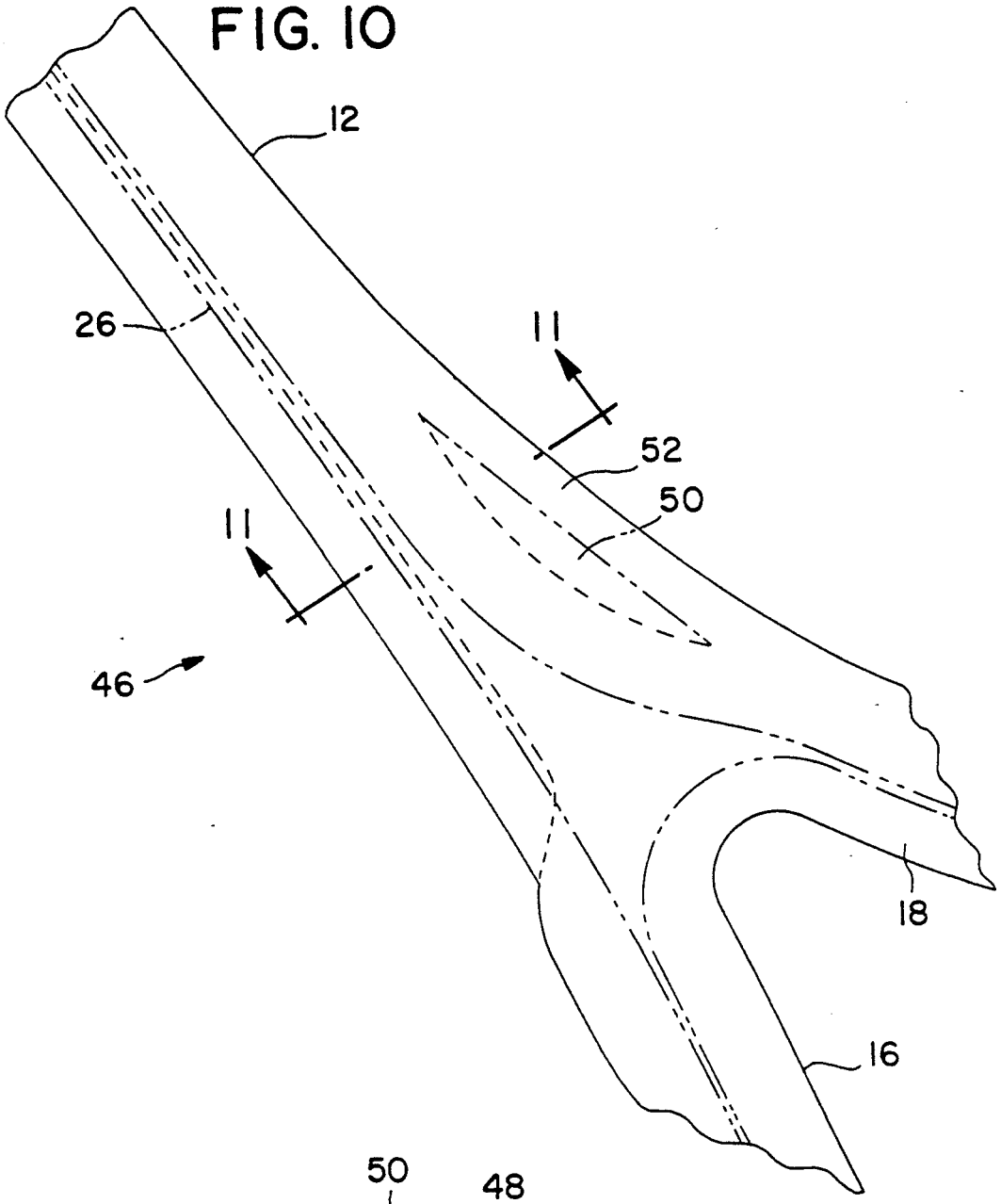
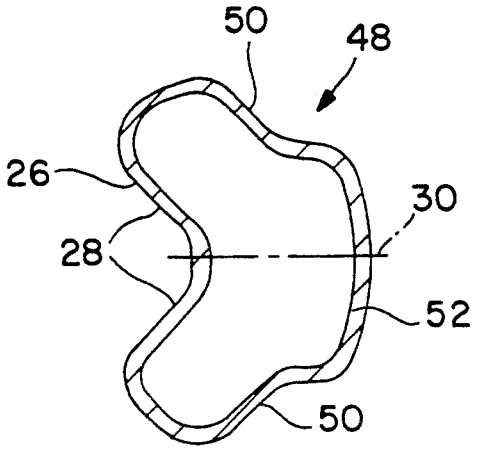
FIG. 11

DOUBLE STRUNG TENNIS RACQUET

This application is a continuation of application Ser. No. 07/989,267, filed on Dec. 11, 1992, now abandoned.

FIELD OF INVENTION

The present invention relates to an improvement in tennis racquets of the type having two, generally parallel strung surfaces.

BACKGROUND OF THE INVENTION

Conventionally, tennis racquets have a head portion defining an opening which contains a plurality of interwoven main (i.e., longitudinal) and cross strings which form a strung hitting surface. The strung surface lies generally in a plane located midway between the front and rear faces of the frame member.

It has been proposed, as an alternative to a single strung surface, to provide two parallel strung surfaces lying generally on opposite sides of the frame, i.e., a double strung racquet. Double strung racquets offer potential advantages over a single strung racquet. However, in practice designing a double strung racquet that would be commercially acceptable poses unique problems. The frame must be strong enough to carry the load of the additional strings, and yet remain at an acceptable weight. Further, the frame must have an acceptable construction in terms of how the strings are secured to the frame.

While there have been a number of previous proposals for double strung racquets, it would be desirable to provide a double strung racquet which, compared to racquets having a single stringing plane, provides two strung surfaces without unduly increasing the weight, which has a frame which provides performance comparable to a single strung racquet, and which has an improved construction, compared to prior proposals for double strung racquets, for securing the strings to the frame.

SUMMARY OF THE INVENTION

In accordance with the present invention, a sports racquet, preferably a tennis racquet, has a frame which includes a frame head portion with an outwardly facing stringing groove and an inwardly facing surface which is generally convex and which defines a stringing area. The stringing groove includes a pair of angled side wall surfaces disposed on opposite sides of the central stringing plane. The head portion includes a plurality of stringing holes, including a first series of string holes extending from one of the side wall surfaces through the convex surface and a second series of string holes extending from the other side wall surface through the convex surface. The first and second series of string holes diverge from the central plane at opposite angles. The racquet further includes a first plurality of interwoven strings extending through the first series of string holes and a second plurality of interwoven strings extending through the second series of string holes, thereby to form two parallel strung surfaces which extend from the convex surface on opposite sides of the central plane.

Preferably, the string holes extend at an angle of about 45° relative to the central plane of the stringing area, and the angled surfaces in the stringing groove, and the opposing surface on the convex surface, are parallel to one another and generally perpendicular to the direction of the string hole.

Preferably also, the racquet frame is formed from a continuous tubular profile member, which defines the head portion and has opposed frame throat portions extending therefrom that converge to form a throat area. A throat bridge has opposite ends which are joined to the opposing frame throat portions at a pair of throat joints. The outwardly facing stringing groove continues down into the region of the throat joint. At the throat joint, the inwardly facing surface comprises, in cross section, a pair of shoulders on opposite sides of the central plane and a central boss section disposed between the shoulders and extending inwardly toward the strung surface. String holes extend from the angled side wall to the respective shoulders. The shoulders are perpendicular to the angle of the string holes, limit the distance through the frame necessary to form the string holes, and allow the strings to pass inwardly without contacting the central boss.

For a better understanding of the invention, reference is made to the following detailed description of a preferred embodiment, taken in conjunction with the drawings accompanying the application.

BRIEF DESCRIPTION OF THE DRAWINGS

FIG. 10 is an enlarged, front view of the junction of the throat bridge and head portion of the racquet of FIG. 1;

FIG. 11 is a sectional view, taken through lines 11—11 of FIG. 10;

DETAILED DESCRIPTION OF A PREFERRED EMBODIMENT

Figure 1:
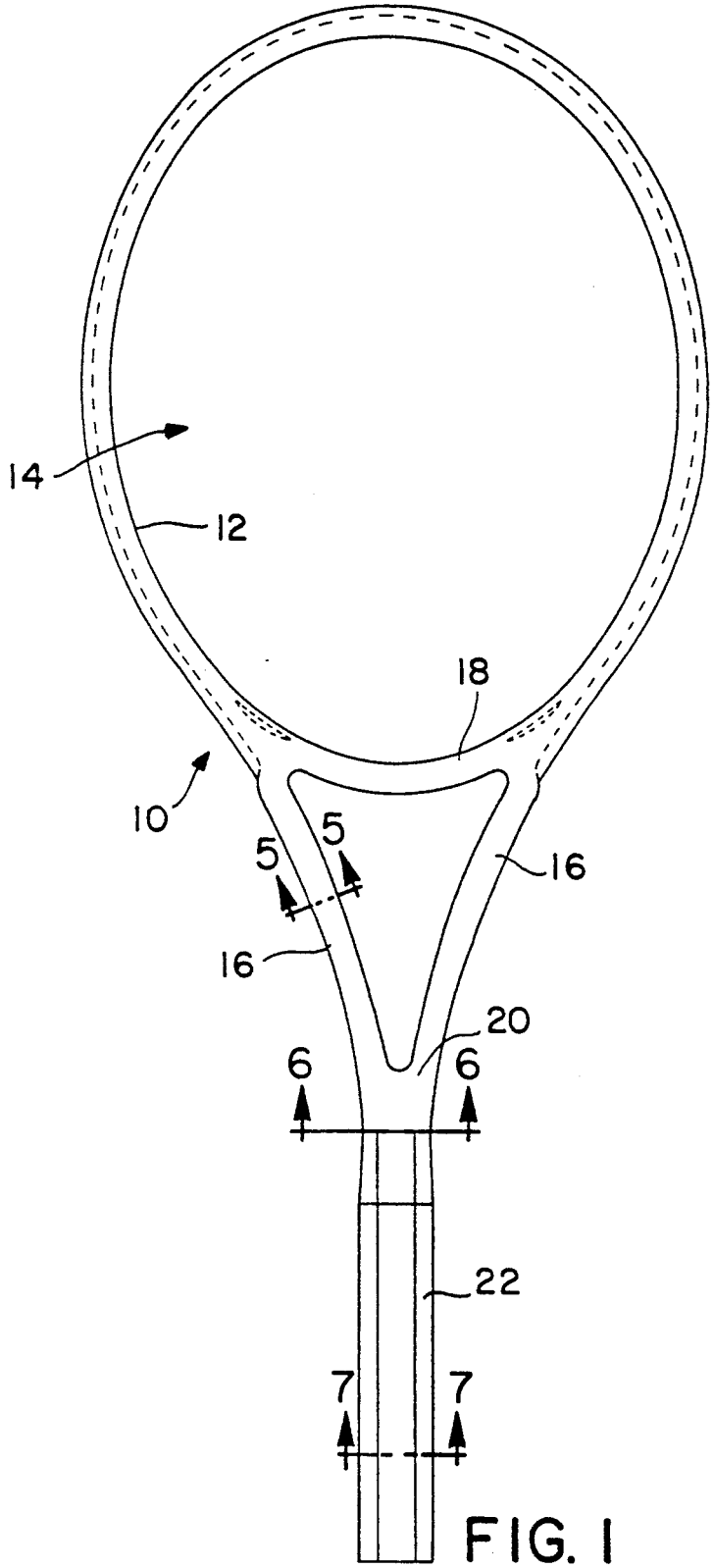
FIGS. 1 and 2 are front and side views, respectively, of a tennis racquet according to the invention.
Figure 2:
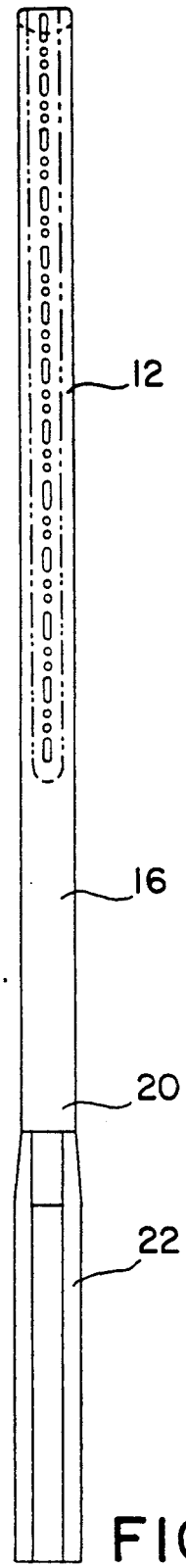
Figure 6:
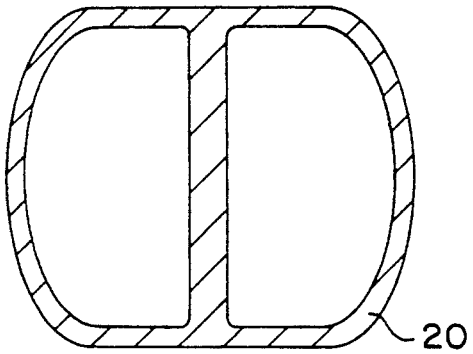
FIG. 6 is an enlarged sectional view of the shaft of the racquet, taken through lines 6—6 of FIG. 1.
Figure 7:
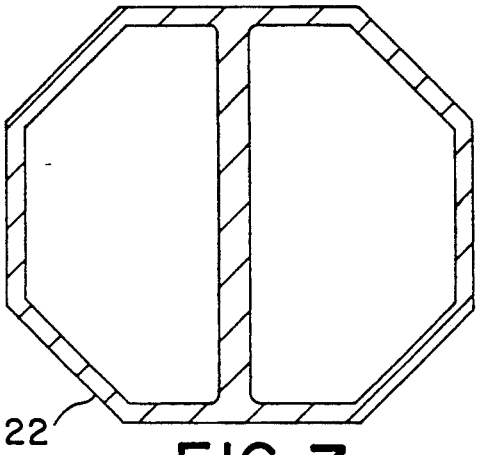
FIG. 7 is an enlarged sectional view of the racquet handle, taken through lines 7—7 of FIG. 1.

FIGS. 1 and 2 illustrate a tennis racquet which includes a frame 10 having a frame head portion 12 defining a stringing area 14. A throat bridge 18 spans the throat area to enclose the lower end of the stringing area 14. A pair of opposed frame throat portions 16 extend from the head portion 12 and converge to extend side-by-side and form a shaft 20, as shown in FIG. 6. A portion of the shaft 20 is molded into the shape of a handle 22. The molded-in handle 22 is shown in cross section in FIG. 7.

Figure 9:
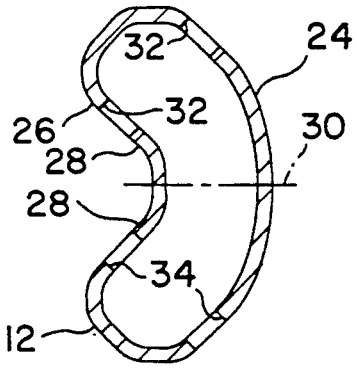
FIG. 9 is an enlarged sectional view of the head portion of the racquet, taken through lines 9—9 of FIG. 3.

FIG. 9 shows the general configuration of the cross section of the head portion 12. As shown, the head portion 12 has a generally convex surface 24 which faces inwardly toward the stringing area 14, and an outwardly facing stringing groove 26. The stringing groove 26 includes a pair of angled side wall surfaces 28 disposed on opposite sides of the central plane 30 of the stringing area. The side wall surfaces 28 are disposed at an angle of less than 180° relative to one another, as shown.

The head portion 12 includes a plurality of string holes therethrough, including a first series of string holes 32 lying on one side of the central plane 30, and a second series of string holes 34 lying on the opposite side of the central plane 30. As shown in FIG. 9, each string hole, 32,34 extends from its respective side wall surface 28 through the opposed convex surface 24. The two sets of string holes diverge from the central plane 30 at opposite angles, which are preferably 45° (i.e., such that the string holes 32, 34 extend at a 90° angle relative to one another). Moreover, the wall surfaces 28 and 24 are formed at an angle such that the string holes 32, 34 are generally perpendicular to the respective surfaces. Thus, the surfaces 24, 28, in the region where the string holes are formed, are generally parallel to one another.

Figure 4:
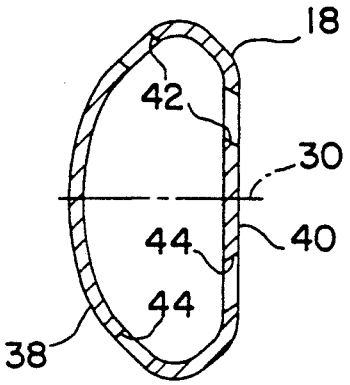
FIG. 4 an enlarged sectional view of the throat piece of the racquet, taken through lines 4—4 of FIG. 3.
Figure 5:
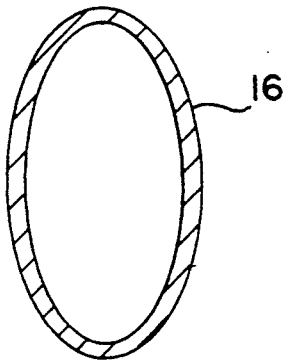
FIG. 5 is an enlarged sectional view of the throat portion of the racquet, taken through lines 5—5 of FIG. 1.

FIG. 4 illustrates the throat piece 18 and its hole configuration. The throat piece has a generally convex surface 38 which faces inwardly toward the stringing area 14. Surface 38 preferably has the same configuration as surface 24, so that the border of the stringing area is a uniform shape. Unlike head portion 12, however, the outwardly facing surface 40 of the throat piece 18, in cross section, is preferably flat. A first series of string holes 42, corresponding to string holes 32 in the frame portion 12, lies on one side of the central plane 30, and a second series of string holes 44, corresponding to holes 34, lies on the opposite side of the central plane 30. As shown in FIG. 4, each string hole, 42, 44 extends from the outer surface 40 through the opposed convex surface 38. The two sets of string holes diverge from the central plane 30 at opposite angles, which are preferably 35°.

Figure 8:
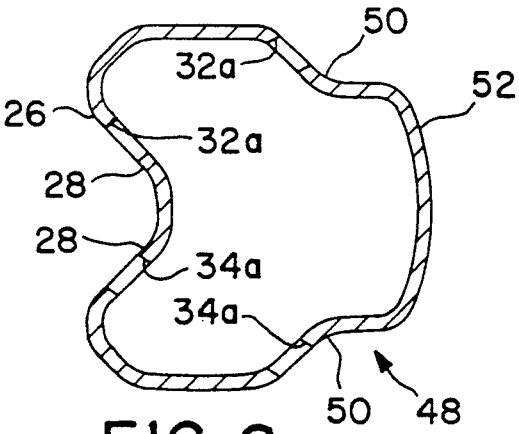
FIG. 8 is an enlarged sectional view of the throat joint between the head portion and throat piece, taken through lines 8—8 of FIG. 3.

As can be seen in FIGS. 3, 8, 10, and 11, the lower corners of the head portion 12, in the region 46 where the throat piece 18 is joined, have a specially shaped profile. The outwardly facing stringing groove 26 continues down into the region of the throat joint 46 However, the inwardly facing surface 48 comprises, in cross section, a pair of shoulders 50 on opposite sides of the central plane 30 and a central boss section 50 disposed between the shoulders and extending inwardly toward the strung surface 14. As shown in FIG. 8, string holes 32*a*, 34*a* extend from each angled side wall to each of the shoulders 52. The string holes 32*a*, 34*a* diverge from the central plane 30 at an angle of approximately 35°. The shoulder sections 50 are angled so as to be approximately normal to the direction of the string holes. In addition to providing surfaces which are generally perpendicular to the holes 32*a*, 34*a*, the shoulders reduce the length that the string holes need to travel through the frame profile. Also, the shoulders act to space the strings in the lower corners of the racquet so as to avoid contact with the central boss section 52.

Figure 3:
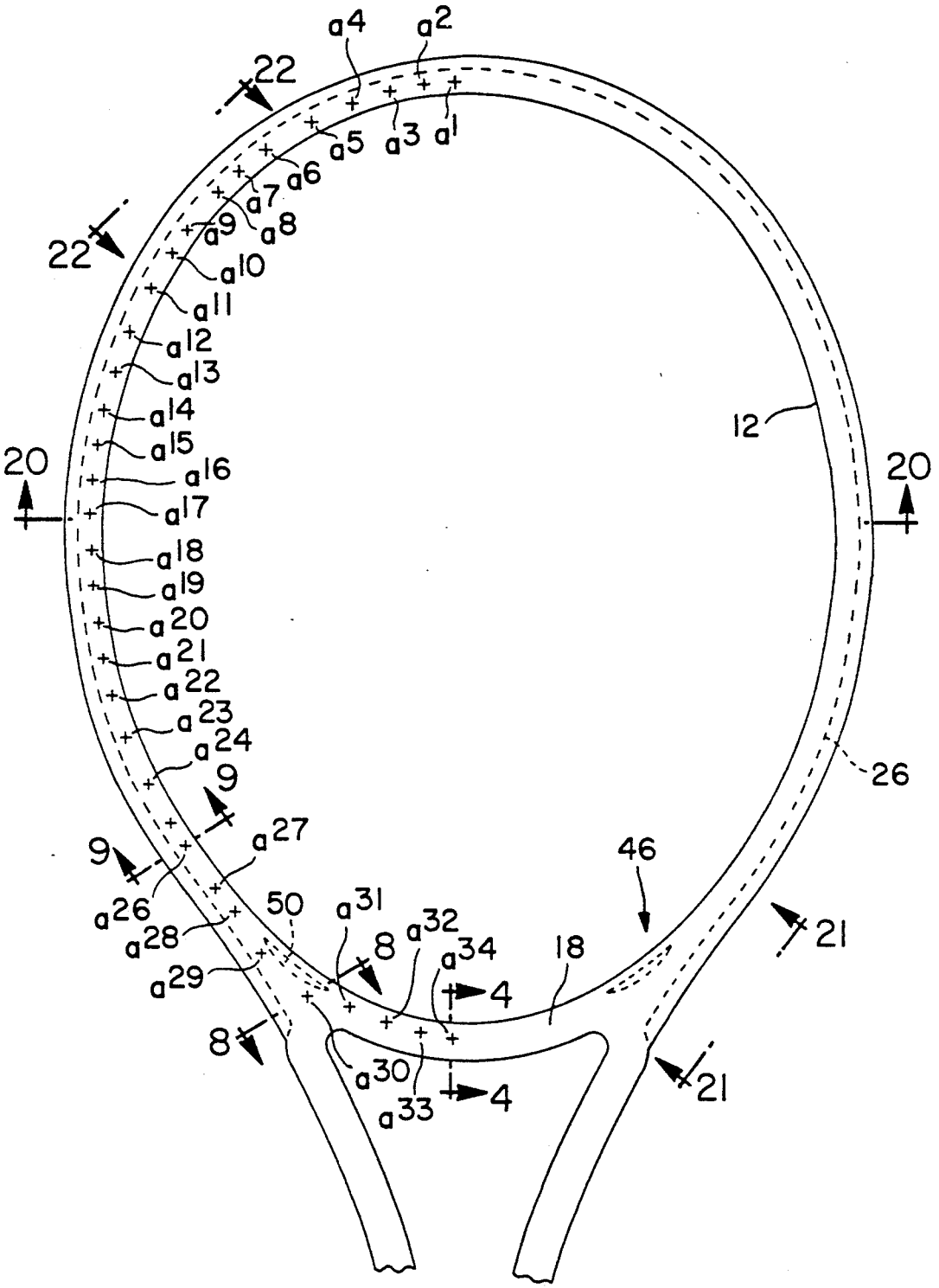
FIG. 3 is a front view of the head portion of the racquet, showing the location of string holes.

FIG. 3 shows an exemplary arrangement of string holes for one series of holes. e.g., 32, 32*a*, and 42, which are labelled as $a^1$ through $a^{34}$. The string holes for the opposite side of the racquet are a mirror image. In the stringing arrangement shown, holes $a^1$ through $a^6$, $a^8$, $a^{10}$, $a^{25}$, $a^{27}$, and $a^{29}$ through $a^{34}$ would be used for the main strings, whereas the remaining string holes would be used for the cross strings, as described further below.

The racquet frame 10 may be molded utilizing known techniques. For example, if the frame is to be made of a fiber reinforced thermoset resin, a tubular profile member of, e.g., uncured fiber-reinforced resin, is placed in a mold having the shape of a racquet. A throat member is also positioned in the mold. The junction between the profile tube and throat piece is wrapped with additional fiber-reinforced resin material as needed. The mold is then closed and the profile member is internally pressurized and heated to conform to the mold and cure. Thereafter, the now formed frame is removed from the mold and string holes are drilled. Alternatively, the frame may be formed with a fiber-reinforced thermoplastic material, as disclosed in commonly owned, copending U.S. application Ser. No. 07/645,255.

The preferred embodiment of the invention employs plastic grommet strips as seats for the strings in the string grooves along the sides and throat, and a plastic bumper strip around the outer portion of the frame to act as a seat for the strings and to protect the outer surface of the frame from damage from accidental impact with the ground or other surfaces. In the frame of FIG. 1, the holes extend at a 45° angle relative to the central stringing plane yet are generally perpendicular to the angled surfaces 28 in the stringing groove 26. Thus, conventional bumper and grommet strips could not accommodate such hole angles and at the same time remain flat against the angled surfaces 28.

Figure 12:
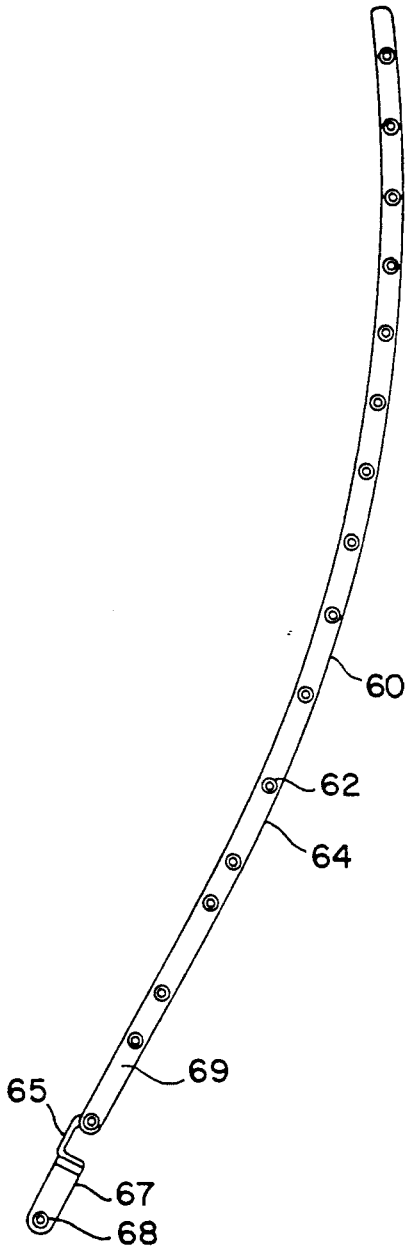
FIGS. 12-14 are bottom, side and top views, respectively, of a grommet strip for use with the racquet of FIG. 1.
Figure 13:
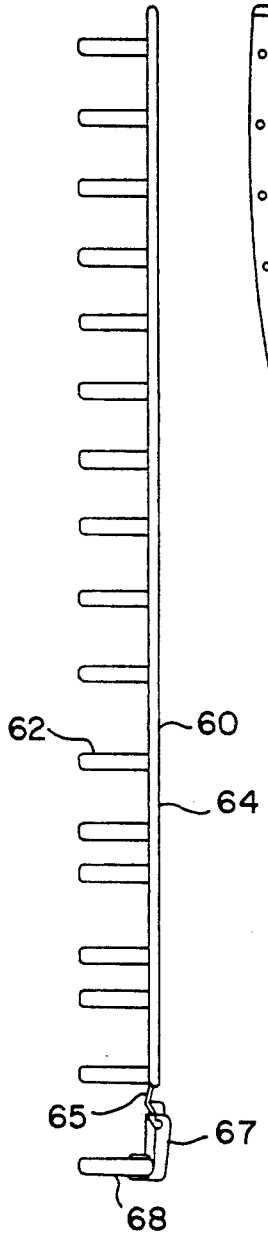
Figure 14:
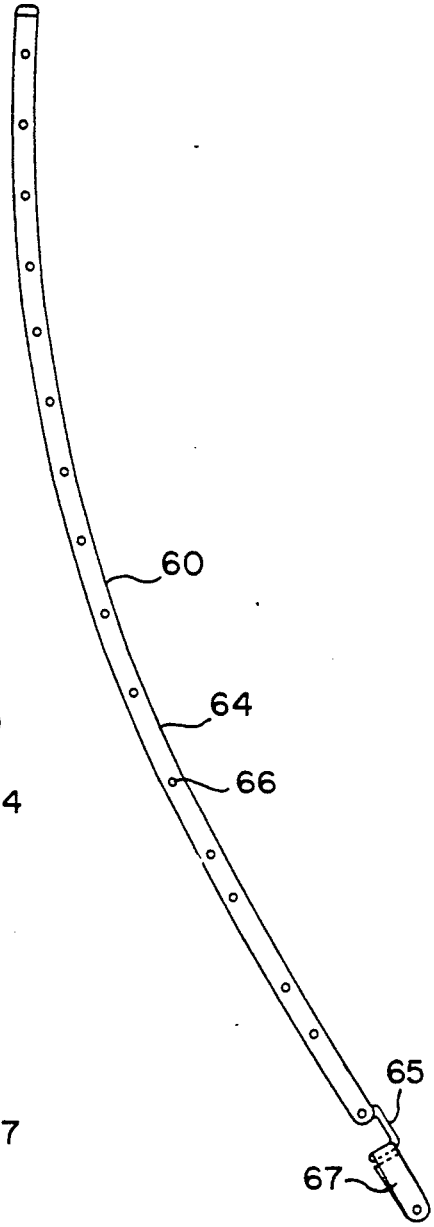
Figure 15:
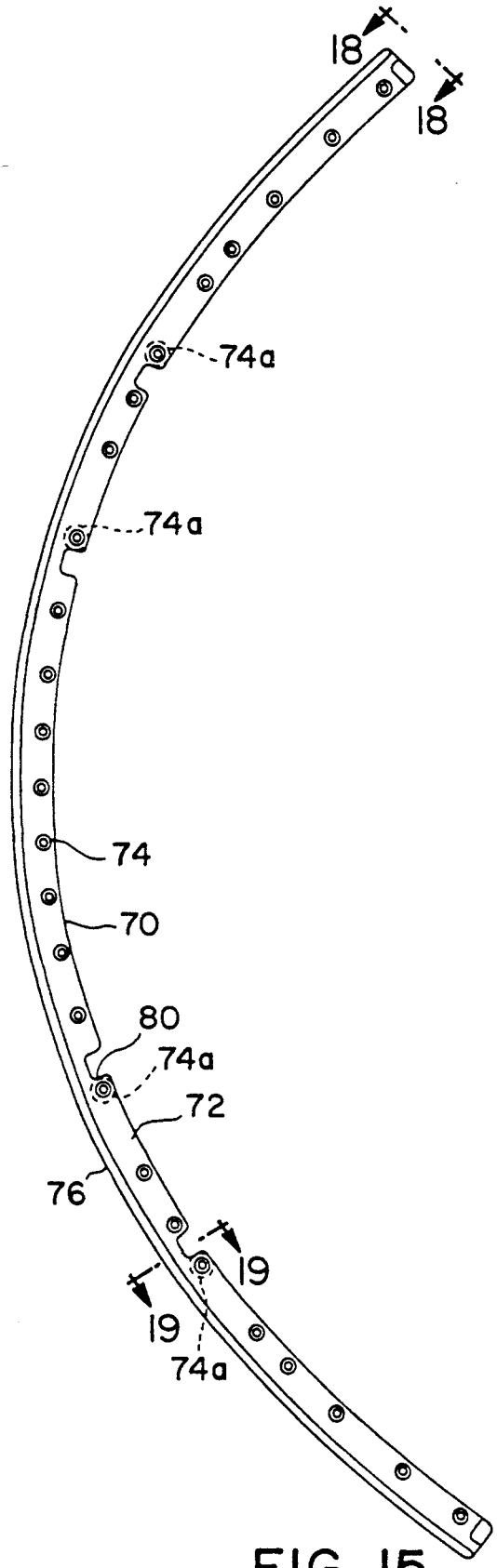
FIGS. 15-17 are bottom, side, and end views, respectively, of a bumper strip for use with the racquet of FIG. 1.

A preferred embodiment of a grommet strip 60 according to the invention is shown in FIGS. 12-14. A preferred embodiment of a bumper strip 70 is shown in FIGS. 15-19.

A grommet strip 60 according to the invention includes a plurality of grommet pegs 62, which fit in the string holes 32, 34, and a thin, connecting strip 64. Each grommet peg 62 extends perpendicular to the connecting strip 64 and has a central longitudinal bore 66 through which a string can pass.

It is not practical to mold a plastic grommet piece on a 45° angle with all grommets pointing toward the center of curvature as required on a racquet frame. However, it is possible, by flattening out the curved portion of the cone representing surface 28, to create a two dimensional piece, in which the connecting strip 64 is flat, and the grommet pegs 62 extend normal to the connecting strip 64. To do so, the shape of the connecting strip 64 is determined by considering each surface 28 of the bevelled 45° string groove 26 to represent a portion of a cone having a vertex angle of 90°. If the section of the cone represented by the surface 28, together with the projecting grommet pegs, is flattened out, the result is a part in which, as shown in FIGS. 12 and 14, the axis of the connecting strip 64 is curved. As can be seen, the grommet pegs lie along the same curve, rather than in a straight line. However, all of the grommet pegs extend normal to the connecting strip surface. Such a part can be readily molded and yet, when bent to lie flat against the stringing groove surface 28, will resume the shape of the cone section and cause the grommet pegs 62 to extend inwardly at the desired angle.

If the head portion 12 of the racquet were circular, the connecting strip 64 would follow a constant curve. However, in most tennis racquets, including the racquet shown in FIG. 1, the head is generally elliptical in shape, rather than circular. As a result, the stringing groove 26 extends about an elliptical curve. Thus, while the 45° string hole angle remains constant (except as discussed below), the radius of curvature of the stringing groove varies at different locations of the head portion of the racquet. In order to conform the bumper strip to the stringing groove at various locations on the head, the radius of curvature of the connecting strip is varied as a function of the radius of curvature of the stringing groove so that the connecting strip 64 lies flat against the surface 28 and the grommet pegs 62 project at the desired angle.

Referring again to FIG. 3, in order for string hole $a^{30}$ to emerge at the desired position on the interior side of the frame surface, due to the increased thickness of the frame at the throat joint 46, the string hole $a^{30}$ extends at a different angle, in the stringing plane, than the adjoining holes, e.g. $a^{29}$ and $a^{28}$. To accommodate the angle of string hole $a^{30}$, a joint 65 is provided between the main section of the connecting strip 64 and the end strip 67 holding the end grommet peg 68. This allows the end strip 67 to be rotated and pivoted as needed about the centerline 69 of the grommet strip 60 to accommodate the angle of hole $a^{30}$.

Figure 16:
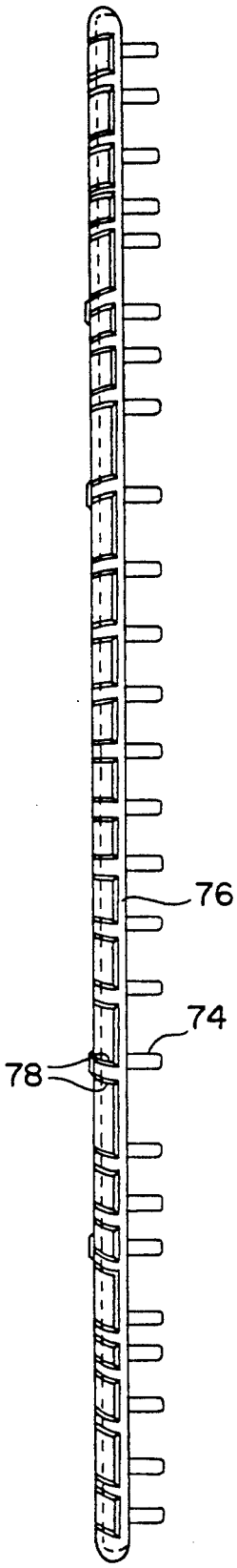
Figure 19:
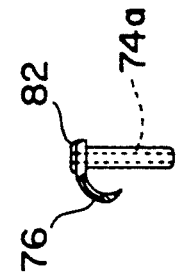
FIG. 19 is a cross-sectional view of the bumper strip of FIG. 15, taken through lines 19—19 of FIG. 15.
Figure 18:
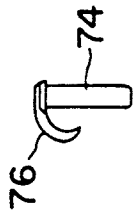
FIG. 18 is an axial end view of the bumper strip of FIG. 15.
Figure 17:
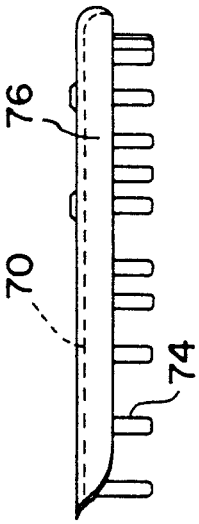

Bumper strip 70 is formed in a similar manner to grommet strip 60, using the theory of cones to define the radius of curvature of the connecting strip 72. As shown, bumper strip includes grommet pegs 74, along with a bumper guard 76 that fits over the outer surface of the racquet frame. As shown in FIG. 16, the bumper guard 76 may be formed with rectangular depressions 78 (which are omitted in FIG. 17 for clarity), which can be used to reduce weight and provide an ornamental appearance. In addition, the connecting strip includes a plurality of cutouts 80 adjacent to selected grommet pegs 74*a*. The upper surface 82 of the selected grommet pegs 74*a* are raised, as described further in connection with FIG. 22.

Figure 23:
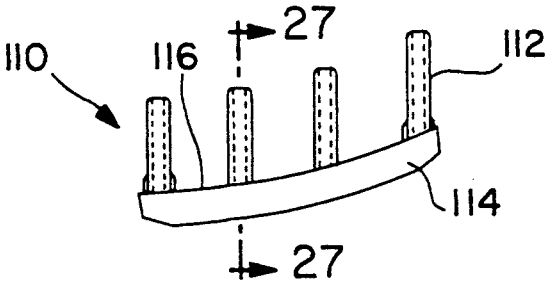
FIGS. 23-26 are front, side, top and bottom views, respectively, of a throat grommet strip for use in the racquet of FIG. 1.
Figure 24:
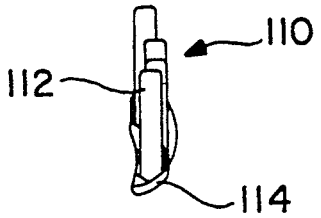
Figure 25:
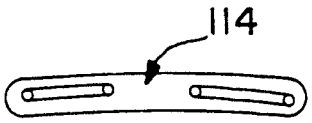
Figure 26:
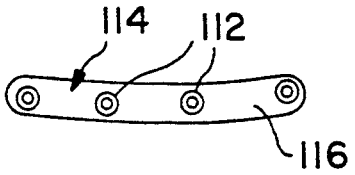
Figure 27:
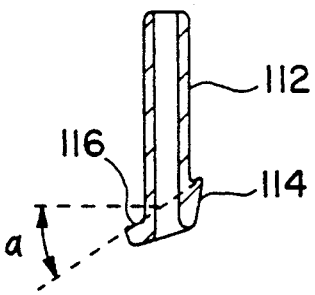
FIG. 27 is an enlarged sectional view, taken through lines 27—27 of FIG. 23.

Throat grommet strips 110, one of which is shown in FIGS. 23–27, are preferably also utilized in the bridge piece 18. Referring to FIGS. 23, 24, and 27, the grommet strip 110 includes four grommet pegs 112 and a connecting strip 114. The grommet pegs 112 are parallel to one another but, as shown in FIG. 23, the connecting strip is curved so that its upper surface 116 follows the curvature of the throat piece 18. Moreover, as shown in FIG. 27, the upper surface 116, in cross section, is sloped at an angle $\alpha$ relative to the grommet pegs 112, which angle $\alpha$ is preferably 35°, such that the upper surface can be flat against the throat piece surface and such that the grommet pegs extend at a 35° angle up into the throat piece holes.

Because the holes in the bridge piece, $a^{31}$–$a^{34}$, are drilled parallel to the racquet axis, the distance through the string holes 42, 44, i.e., the distance from the outer surface 40 to the inner surface 38 (see FIG. 4), varies, i.e., is slightly greater for string hole $a^{31}$ than for string hole $a^{34}$. Because the string holes 42, 44 emerge at the same location on concave inner surface 38, the angle of the string holes $a^{31}$–$a^{34}$ relative to the flat, outwardly facing surface 40, while approximately 35°, varies slightly from string hole $a^{31}$ to string hole $a^{34}$.

As a result the angle $\alpha$ of the grommet pegs 112 of the throat grommet strip 110, when placed on the surface 40, will need to vary accordingly. It would be desirable to mold the grommet strip 110 so that the grommet pegs 112 are initially parallel to one another, and yet when inserted through the string holes vary the angle $\alpha$ to conform to the varying string hole angle. In order to do so, the connecting strip 114 is curved, as shown in FIGS. 25 and 26, such that the longitudinal axis of the grommet pegs 112 also are disposed along a curve rather than a straight line. In this manner, when the strip 114 is bent straight to be mounted on the throat piece 18, the angle of the grommet pegs will bend to accommodate the variable angle of the string holes $a^{31}$–$a^{34}$.

Figure 20:
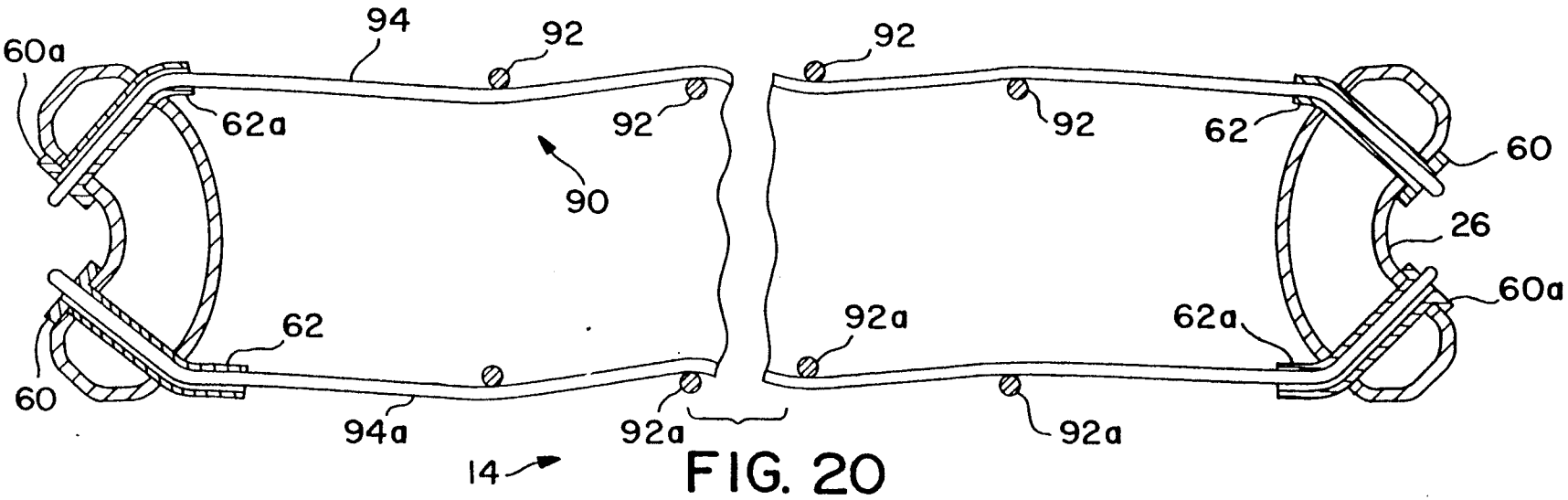
FIG. 20 is an enlarged, sectional view of the racquet head, taken through lines 20—20 of FIG. 3, and further showing the grommet strip and stringing.
Figure 21:
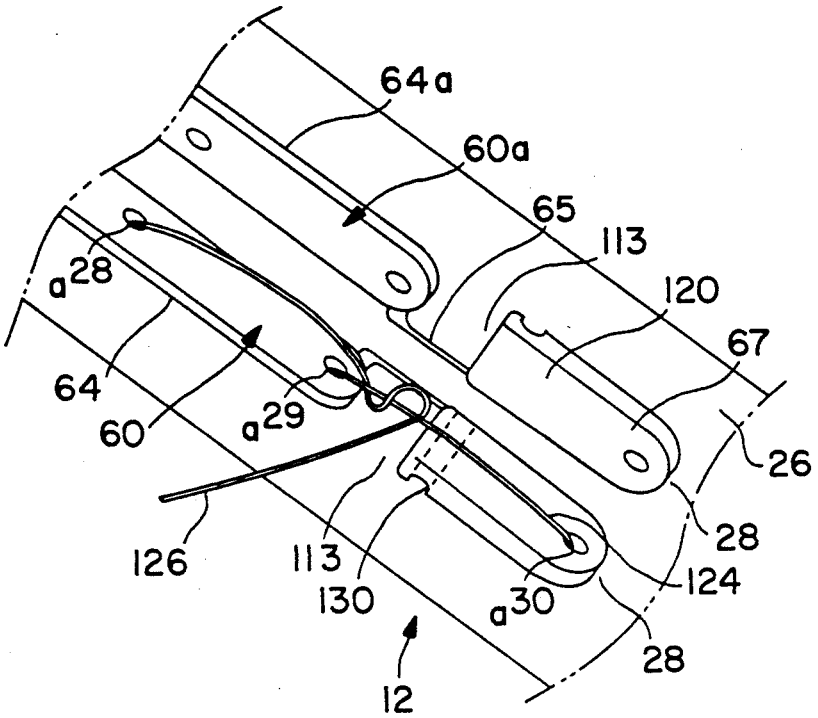
FIG. 21 is an enlarged view, taken in the direction of lines 21—21 of FIG. 3, showing a string tie-off location.

Racquet assembly and stringing will be described with reference to FIGS. 20–22. Referring to FIGS. 20 and 21, in order to string the racquet frame 10, a pair of grommet strips 60 and 60*a* are positioned in the stringing groove 26 along each side of the frame 10, starting above the throat. Grommet strip 60*a* is a mirror image of grommet strip 60, so that it is molded with opposite curvature. As discussed above, when the grommet strips 60, 60*a* are bent to follow the curvature of the head portion 12 of the frame, the connecting strips 64, 64*a* will lie flat against the surfaces 28, and the grommet pegs 62 will extend through the 45° stringing holes at the proper angle.

A pair of bumper strips 70 (see FIG. 22) are then positioned in the remaining portion of the stringing groove 26, so as to extend between the grommet strips 60, 60*a*. Separate bumper strips do not need to be molded for the opposite sides of the stringing groove, in that the two bumper strips 70 are merely oriented in opposite directions so as to fit the respective surfaces 28.

Finally, four throat grommet strips are positioned so that grommet peg project through the holes in the throat piece 18. Two of the grommet strips are grommet strips 110, whereas the other two grommet strips are mirror images of strip 110, with an opposite curvature.

Once the grommet strips and bumper strips are in place, each strung surface 90 and 90*a* is strung with a plurality of interwoven main strings 92, 92*a* and cross strings 94, 94*a* (one cross string for each surface is shown in FIG. 20).

Although the specification refers to a plurality of main and cross strings, normally a racquet is strung with only one or two long strings, which are directed from hole-to-hole and extend along the grommet or bumper strip between holes. As used herein, the terminology main strings and cross strings includes the use of an elongated string where each cross string or main string is only a segment of a longer string.

Stringing may be done with any desirable stringing pattern. As shown in FIG. 21 and 22, however, preferably the ends of the strings are tied off in the stringing groove, rather than on the inside of the strung surface 14, as is customary. In this connection, the grommet strips and bumper strips are provided with a tie-off system located in the stringing groove. More particularly, the tie off system includes a raised portion on the bumper strip or grommet strip that allows a string to pass over the raised portion and leaves an interstitial area below the string which can be used to tie off another string.

Figure 22:
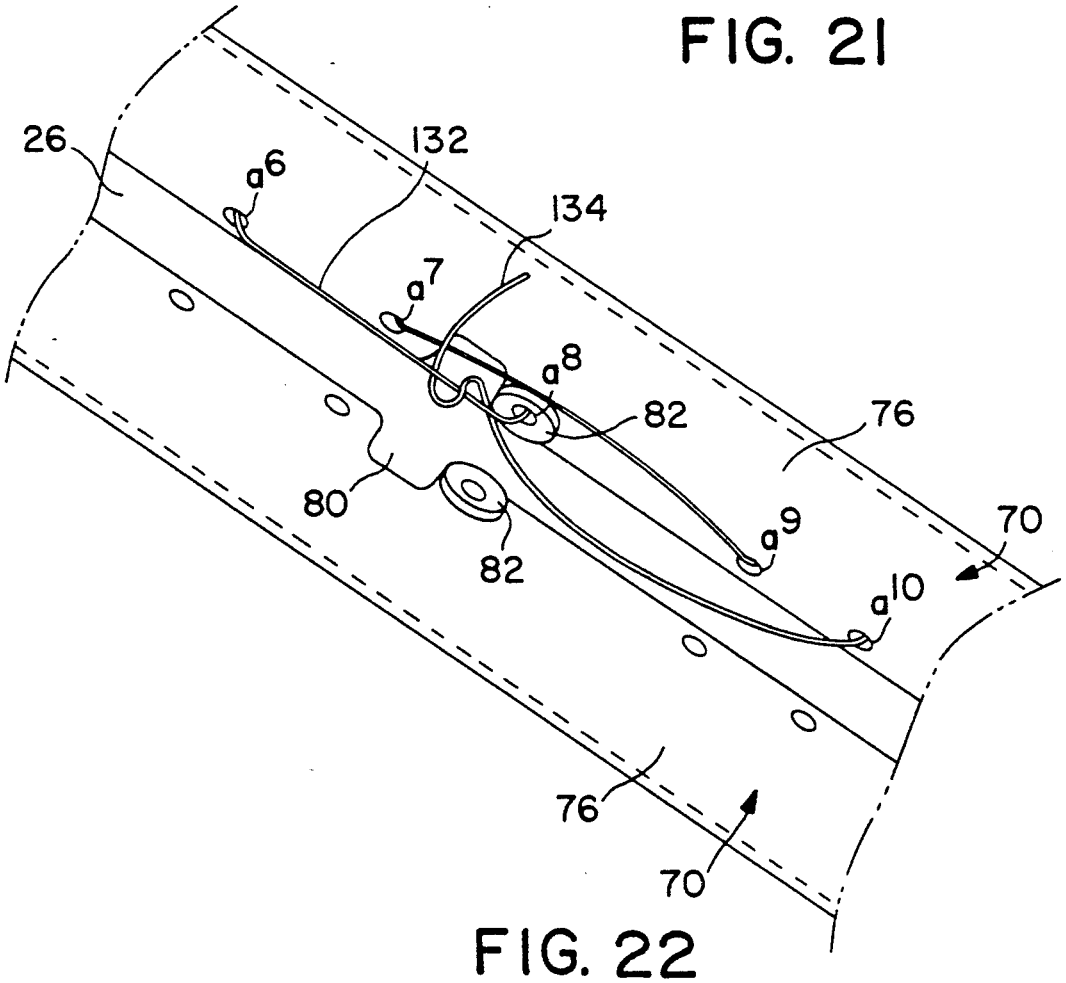
FIG. 22 is an enlarged view, taken in the direction of lines 22—22 of FIG. 3, showing another string tie-off location.

An exemplary tie-off system is shown in FIGS. 21 and 22. In the case of the grommet strip 60, a raised portion 120 is formed on the connecting strip 64, in this case on the end strip portion 67. In addition, the point 65 is disposed to the side of the strip 64, 67 so as to leave a recessed area 113 directly adjacent the raised portion 110. As shown, string portion 124, which passes between holes $a^{29}$ and $a^{30}$, extends over the recessed area 113 and is raised by raised portion 120. As a result, loose string end 124 exiting from the string hole $a^{28}$ can readily be tied around the string portion 124, utilizing the recessed area 113. Moreover, the raised portion 110 is provided with a groove 130. After tying the string end, 126, it can be trimmed, and the remaining end inserted into the groove 130.

The bumper strip 70 similarly includes raised areas 82, over which a string portion 132 extends, which cooperate with adjacent recesses 80 formed in the connecting strip 72, to provide a tie-off area for a loose string end 134.

The foregoing represents a preferred embodiment of the invention. Variations and modifications will be apparent to persons skilled in the art, without departing from the inventive concepts disclosed herein. All such modifications and variations are intended to be within the skill of the art, as defined in the following claims.

I claim:

1. A sports racquet having a frame including a frame head portion defining a stringing area having a central plane, wherein said frame head portion has an outwardly facing stringing groove and an inwardly facing inner surface defining a stringing area; wherein said stringing groove includes a pair of angled side wall surfaces disposed on opposite sides of said central plane; and wherein said head portion includes a plurality of stringing holes therethrough, including a first series of string holes extending from one of the side wall surfaces through said inner surface and a second series of string holes extending from the other side wall surface through said inner surface, said first and second series of string holes diverging from said central plane at opposite angles; wherein portions of said side wall surfaces and said inner surface surrounding said string holes lie generally perpendicular to the direction of the respective string hole; and further comprising a first plurality of interwoven strings extending through said first series of string holes and a second plurality of interwoven strings extending through said second series of string holes, thereby to form a pair of at least generally parallel strung surfaces which extend from said inner surface on opposite sides of said central plane.

2. A tennis racquet according to claim 1, wherein said inner surface is generally convex.

3. A tennis racquet according to claim 1, wherein said frame includes a continuous tubular profile member which defines said head portion and which has opposed frame throat portions extending therefrom that converge to form a throat area, and a throat bridge having opposite ends which are joined to the opposing frame throat portions at a pair of throat joints; and wherein each said throat joint includes an outwardly facing stringing groove including a pair of angled side wall surfaces disposed on opposite sides of said central plane; and an inwardly facing surface comprising, in cross section, a pair of shoulders on opposite sides of said central plane and a central boss section disposed between said shoulders and extending inwardly toward said strung surface; and including at least one string hole extending from each angled side wall to each of said shoulders, whereby the respective at least one string for each strung surface extends inwardly without contacting said central boss section.

* * * * *